US005484549A

United States Patent [19]

Hei et al.

[11] Patent Number: 5,484,549

[45] Date of Patent: Jan. 16, 1996

[54] POTENTIATED AQUEOUS OZONE CLEANING COMPOSITION FOR REMOVAL OF A CONTAMINATING SOIL FROM A SURFACE

[75] Inventors: Robert D. Hei, Cottage Grove; Thomas R. Oakes, Lake Elmo; Guang-jong J. Wei, Mendota Heights, all of Minn.

[73] Assignee: Ecolab Inc., St. Paul, Minn.

[21] Appl. No.: 114,193

[22] Filed: Aug. 30, 1993

[51] Int. Cl.[6] ..... C11D 3/395; C11D 7/06; C11D 7/54

[52] U.S. Cl. ..... 252/103; 252/95; 252/135; 252/156; 252/173; 252/174.14; 252/174.15; 252/174.16

[58] Field of Search ..... 252/103, 95, 135, 252/156, 173, 174.14, 174.15, 174.16

[56] References Cited

U.S. PATENT DOCUMENTS

| | | | |
|---|---|---|---|
| 3,217,294 | 11/1965 | Gerlach et al. | 340/146.34 |
| 3,249,985 | 5/1966 | Weller et al. | 29/96 |
| 4,063,890 | 12/1977 | Baron et al. | 21/54 R |
| 4,104,187 | 8/1978 | Sibley et al. | 252/106 |
| 4,116,859 | 9/1978 | Merkl | 252/186 |
| 4,214,014 | 7/1980 | Hofer et al. | 427/40 |
| 4,505,836 | 3/1985 | Fairchild | 252/174.14 |
| 4,666,722 | 5/1987 | Creed et al. | 426/393 |
| 4,690,772 | 9/1987 | Tell et al. | 252/106 |
| 4,898,679 | 2/1990 | Siegel et al. | 210/752 |
| 4,933,411 | 6/1990 | Gifford | 426/399 |
| 4,956,098 | 9/1990 | Stevens et al. | 210/748 |
| 4,959,124 | 9/1990 | Tsai | 162/65 |
| 5,006,124 | 4/1991 | Tieckelmann et al. | 8/111 |
| 5,053,140 | 10/1991 | Hurst | 210/704 |
| 5,097,556 | 3/1992 | Engel et al. | 8/158 |
| 5,118,322 | 6/1992 | Wasinger et al. | 8/111 |
| 5,180,500 | 1/1993 | McConnell | 210/721 |
| 5,181,399 | 1/1993 | Engel et al. | 68/13 R |
| 5,192,459 | 3/1993 | Tell et al. | 252/106 |
| 5,330,672 | 7/1994 | Langer et al. | 252/108 |
| 5,330,752 | 7/1994 | Park et al. | 424/94.4 |
| 5,332,518 | 7/1994 | Kuroda et al. | 252/99 |
| 5,332,527 | 7/1994 | Heinzman et al. | 252/546 |

FOREIGN PATENT DOCUMENTS

| | | |
|---|---|---|
| 357710 | 1/1929 | Belgium . |
| 1345086 | 10/1962 | France . |
| 3007670A1 | 9/1981 | Germany . |
| 3209930 | 9/1983 | Germany . |
| 3320841A1 | 1/1985 | Germany . |
| 3320841A1 | 1/1985 | Germany . |
| 3917250 | 12/1990 | Germany . |
| 62-61574 | 3/1987 | Japan . |
| 64-51071 | 2/1989 | Japan . |
| 1-305956 | 12/1989 | Japan . |
| 2-172593 | 7/1990 | Japan . |
| 3-249985 | 7/1991 | Japan . |
| 3-217294 | 9/1991 | Japan . |
| 4-145997 | 5/1992 | Japan . |
| 4-188083 | 7/1992 | Japan . |
| 858735 | 8/1981 | U.S.S.R. . |

OTHER PUBLICATIONS

Environmental Aspects of the Use of Alkaline Cleaning Solutions, A. Grabhoff, Federal Dairy Research Centre, Kiel, F.R., Germany, pp. 107–114. (1989).

The Role of Hydroxyl Radical Reactions in Ozonation Processes in Aqueous Solutions, J. Hoigne and H. Bader, Swiss Fed. Inst. of Tech., Zurich Inst. for Aquatic Sciences and Water Pollution Control, Duebendorf, 8600 Switzerland, pp. 377–386. (Oct. 1975).

A Comparison of the Effectiveness of Ozone and Chlorine in Controlling Biofouling Within Condensors Using Fresh Water as a Coolant, John F. Garey et al., Ozone: Science and Engineering, vol. 1, 1979, pp. 201–207.

Ozone as a Cleaner Touted for Bulk Tanks, Susan Stone, Southern Dairy, Jun. 1993, p. 24.

Cleaning Chemicals—State of the Knowledge in 1985, David R. Kane et al., Diversey Wyandotte Inc., Canada, pp. 312–335. (1985).

Sanitising Treatments for CIP Post–Rinses Brewing and Distilling Inernational, Mar. 1990, pp. 24–25.

Ozone as a Disinfectant in Process Plant, T. R. Bott, Food Control, Jan. 1991, pp. 44–49.

Ozone, The Add–Nothing Sterilant, Robert I. Tenney, Technical Quarterly, Jan.–Mar. 1973, pp. 35–41.

*Industries Alimentaires et Agricoles*, 1978, 95(9/10), pp. 1089–1091, Paragraph 1.2.1 Ozone (English translation attached).

"Surface Disinfection of Raw Produce", *Dairy, Food and Environmental Sanitation*, Larry R. Beuchat, vol. 12, No. 1, pp. 6–9 (Jan. 1992).

"Effect of Ozonated Water on Postharvest Pathogens of Pear in Laboratory and Packinghouse Tests", *Plant Disease*, R. A. Spotts et al., vol. 76, No. 3, pp. 256–259 (Mar. 1992).

DATABASW WPI, Derwent Publications Ltd., London, GB; AN 90–027139 & JP,A,1 305 956 (Chiyoda Seisakusho, Sakara Seiki, Godai Embody) Nov. 12, 1989.

*Primary Examiner*—José G. Dees
*Assistant Examiner*—Barbara S. Frazier
*Attorney, Agent, or Firm*—Merchant, Gould, Smith, Edell, Welter & Schmidt

[57] ABSTRACT

A pH greater than 7 aqueous ozonized cleaning composition can be used for cleaning a tenacious residue or film from solid surfaces. The cleaning properties can be potentiated by additive materials. Ozone, generated by electrical discharge, can be blended into effective aqueous cleaning compositions that can efficiently clean proteinaceous, oily or carbohydrate soil from a variety of surfaces. Immediately after ozone generation, the ozone containing gas stream comprising ozone and the residual air is injected through a hose into an aqueous potentiating additive containing carrier solution, forming a cleaning solution which is applied immediately to a soiled solid surface to remove a contaminating residue or film.

18 Claims, No Drawings

POTENTIATED AQUEOUS OZONE CLEANING COMPOSITION FOR REMOVAL OF A CONTAMINATING SOIL FROM A SURFACE

FIELD OF THE INVENTION

The invention relates to an aqueous cleaning composition. The invention also relates to a method for cleaning a soil, from a surface, that can be a tenacious, contaminating residue or film, such as that derived from an organic or food source. More particularly, this invention relates to a chemical composition and a process, using either active ozone at a pH greater than 7 or using active ozone potentiated by an additive composition, for the removal of a proteinaceous, fatty or carbohydrate containing soil residue or film from a solid surface.

BACKGROUND OF THE INVENTION

A variety of soils are common in the institutional and industrial environment. Such soils include organic soils, inorganic soils and soils comprising mixtures thereof. Such soils include food soils, water hardness soils, etc. The soils are common in a variety of locations including in the foods industry. The modern food processing installation produces food products using a variety of continuous and semicontinuous processing units. The units are most efficiently run in a substantially continuous fashion preferably 24 hours a day to achieve substantial productivity and low costs. The safe and effective operation of such process units require periodic maintenance and cleaning operations. Such operation ensures that the equipment operates efficiently and does not introduce into the food product, bacterial contamination or other contamination from food soil residue. Commonly the production units are made from hard surface engineering material including glass, metals including stainless steel, steel, aluminum; and synthetic substances such as acrylic plastics; epoxy, polyimide condensation products, etc. Contamination can occur on an exterior hard surface or in the interior of pipe, pumps, tanks, and other processing units. Known cleaning methods use aqueous cleaning materials that can be applied in a variety of ways to an exterior hard surface or to an interior surface within such units. A vast array of materials have been disclosed as Clean In Place (CIP) cleaner systems. The predominant systems include strongly acidic or basic formulated cleaners and chlorine based materials such as sodium hypochlorite (NaOCl). Sufficient volumes of liquid cleaning materials can be pumped through the piping to ensure that all interior surfaces are contacted with cleaning materials to effectively remove contaminated soils or films.

These cleaning methods known as CIP procedures, clean the surfaces of food processing equipment without any substantial dismantling of the tanks, pumps valves and pipe work of the processing equipment. Because of the elimination of manual cleaning procedures, increased levels of cleanliness can be better assured through better control and reproducibility of the CIP cleaning process. The choice of an effective aqueous cleaning composition is critical to the success of the cleaning procedure because the effectiveness of the procedure depends on the degree of chemical action of the ingredients of the cleaning solution and the mechanical impact of the spray on the residue. A substantial need exists to increase chemical cleaning effectiveness.

With the increasing awareness of ecological concerns and reports about the undesirable impact of many man-made chemicals in the environment, attempts have been made to find more environmentally compatible cleaning compositions. For example, strong acids and alkali tend to change the pH of the environment, active chlorine or hypochlorite can be noxious to many living organisms and is corrosive to many materials used in food processing. Other cleaning materials can have a certain level of undesirability. Further, efforts to reduce the amount of conventional cleaning chemicals used in hard surface cleaning and in the CIP procedures have become important even if the complete elimination of use of such chemicals is not possible. In addition to cleaning hard surfaces, a sanitizing action is important in cleaning food contact surfaces or CIP installation or units. An aqueous sanitizing agent is usually the last agent applied to the equipment in a CIP protocol.

Ozone ($O_3$) is composed entirely of oxygen atoms. Ozone is a high energy form of oxygen and is unstable at room or higher temperature with the final decomposition product being oxygen. Basic aqueous solutions are known to promote aqueous $O_3$ decomposition when the gas and aqueous media are mixed. The instability of ozone in aqueous base has resulted in the application of ozone in sanitizer technology at a pH of less than 7. However, the use of alkaline cleaners has significant advantages in cleaning certain types of soils that can be resistant to cleaning at a pH of 7 or less.

Of the different types of soil and residue left on food contacting surfaces, proteinaceous residue, such as residue from dairy products are particularly hard to clean. Kane et al., "Cleaning Chemicals—State of the Knowledge in 1985" discuss chemical cleaners in dairy applications. The most common chemical used in cleaning proteinaceous soil from solid surfaces are alkaline, such as sodium hydroxide. Often a 1 to 3% by weight aqueous sodium hydroxide solution is used. Other chemicals may be added in the cleaning solution to potentiate the cleaning, help solubilize the particles, wet the surfaces, or help prevent precipitation. For example, chlorine (NaOCl) may help in breaking down proteins, sequestrants such as EDTA, NTA, sodium tripolyphosphate, may help in preventing the precipitation of hardness ions, and surfactants may help the wetting of solid surfaces. Ozone has not been used as a cleaning additive in these cleaning applications. An acid rinse and a sanitizer (active chlorine, fatty acid sanitizers, etc.) may be used after the proteinaceous residue has been removed. Other sanitizers include peracetic/hydrogen peroxide (See Bowing et al., U.S. Pat. Nos. 4,051,058 and 4,051,059), perfatty acids (See Wang U.S. Pat. No. 4,040,404, etc.).

While not having been used as a cleaning additive in CIP systems, the use of aqueous ozone solutions are known to be disinfectants or sterilants. Tenney, "Ozone, the Add-nothing Sterilant", *Technical Quarterly,* vol. 10, No. 1, pp. 35–41 (Master Brewers Association of America 1973) shows the use of ozone to be a useful sterilant in the form of an aqueous ozone solution having no additive ingredients. Bott, "Ozone as a disinfectant in process plant", *Food Control,* January 1991, pp. 44–49, teaches that ozone can be used as a chlorine replacement for treating industrial water and removing biological growth in the form of microorganisms from hard surfaces. Stillman, "Sanitising treatments for CIP post-rinses", *Brewing & Distilling International,* March 1990, pp. 24 and 25, teaches that post-rinse CIP treatments need careful control to avoid contaminating sanitized surfaces with microorganisms. Stillman teaches that two basic types of treatments are used, the so-called "add-nothing" physical treatment and biocidal treatments. Add-nothing disinfection procedures include filtration, ultraviolet radiation and heat pasteurization to kill microorganisms prior to rinsing. Chemical treatments can include the use of heavy metal such as silver; the use of chlorine, chlorine dioxide, fatty acids, peroxy fatty acids and others. Nowoczin, German Published Patent Application DE 33 20 841, teaches a three-step dairy CIP cleaning process involving a first step of rinsing milk products from the unit followed by a second cleaning step to remove adherent food residues followed by a third step using a cold water rinse. The improvement suggested by Nowoczin involves injecting aqueous ozone in the second cleaning step. Nowoczin suggests the use of a neutral pH and uses ozone with no chemical additives in the ozone injection. Siegel et al., U.S. Pat. No. 4,898,679, teaches an apparatus and a method for manufacturing an aqueous ozone solution. The method of Siegel et al. involves injecting ozone into water to first kill all the microorganisms in the water, passing the treated water to a second zone where it is saturated with ozone, chilling the saturated ozone and maintaining the ozone solution at high concentrations. Siegel et al. does not disclose the use of chemical additives for the purpose of potentiating the ozone action. Garey et al., "*A Comparison of the Effectiveness of Ozone and Chlorine in Controlling Biofouling Within Condensers Using Fresh Water as a Coolant*", *Ozone: Science and Engineering*, Vol. 1, pp. 201–207, 1979, indicate that ozone is a more effective biocide than chlorine and does not produce persistent oxidant residuals similar to known chlorine residuals in waste water. The target of the biocidal activity of the ozone is control of biofouling by environmental microorganisms in fresh water used as a coolant. Grasshoff, "*Environmental Aspects of the Use of Alkaline Cleaning Solutions*", Federal Dairy Research Centre, pp. 107–114, discusses various aspects of alkaline cleaning solutions that do not contain active oxidants such as peroxide, ozone, or chlorine sanitizers but do contain a variety of cleaners including pyrophosphates, sequestrants, gluconates, surfactants, etc.

The low solubility and instability of ozone in aqueous solution is also well known. Sotelo et al., "Ozone Decomposition in Water: Kinetic Study", *Industrial Engineering Chemical Research*, 1987, 26, pp. 39–43, shows that ozone decomposition occurs at a variety of pH's but is substantially enhanced as the pH increases past 6. At pH 10, the half life of ozone is about 1 to 10 seconds. In particular, hydroxide radicals, formed from ozone, at pH's greater than 7 rapidly cause ozone to decompose into other oxidative and nonactive species. The role of hydroxyl radical is pointed out in Hoigne et al., "The Role of Hydroxyl Radical Reactions in Ozonation Processes in Aqueous Solutions", *Water Research*, Vol. 10, pp. 377–386, Pergamon Press 1976. The paper shows that hydroxyl radical formed by hydroxide ion catalytic decomposition of ozone is an active agent in a variety of reactions with organic materials.

Shimamune et al., Japanese Kokai H4-118083 (1992), teaches the treatment of filters with ozone for cleaning purposes. A series of patents discusses aspects of cleaning or sanitizing contact lenses using high energy and ozone compositions including Baron, U.S. Pat. No. 4,063,890; Sibley, U.S. Pat. No. 4,104,187; Hofer et al., U.S. Pat. No. 4,214,014; and Zelez, U.S. Pat. No. 5,098,618. Zelez discloses the use of UV radiation at wavelengths of 185 and 254 nm in the presence of oxygen to reduce the hydrophobicity of the surface of plastic substrates. The radiation produces ozone and atomic oxygen, and the atomic oxygen reacts with the plastic surface to produce the desired hydrophilic effect. Again, there was no mention of the relation of ozone and cleaning adjuvants.

In summary, the prior art indicates that ozone can be used beneficially as a sterilant in the form of a gas and in aqueous solutions at pH's of about 7 or less. However, because of the problems related to the decomposition of ozone in alkaline solutions, the skilled artisan has avoided ozone containing compositions at an alkaline pH or with chemical adjuvants or additives. A substantial need exists for the development of ozone containing cleaning materials in alkaline pH's and for potentiating ozone cleaners in formulated systems. Such pH's are useful for certain types of soil. Further, a substantial need exists for developing compositions using ozone and alkaline ingredients or adjuvants. The combination of these materials can provide cleaning properties not attainable otherwise.

SUMMARY OF THE INVENTION

The invention resides in part in a potentiated aqueous chemical ozone composition and in a method of cleaning soil from solid surfaces, including the cleaning of tenacious proteinaceous soil residues or films from such surfaces. A useful cleaner comprises an ozone solution at a pH greater than 7, preferably greater than 7.5, most preferably using a pH of about 8–13. Further, a concentration of ozone can be introduced into an aqueous diluent containing a Lewis base potentiator, to form a cleaning solution. The cleaning solution is then contacted with solid surfaces. Typically the cleaning solution has a concentration of ozone in the cleaning solution is greater than 0.1 part of ozone ($O_3$) per million parts of the cleaning solution by weight. We have found that along with other oxidative species, formed in-situ in alkaline solution, cleaning properties arise at an oxidation-reduction potential (ORP) value of greater than +350 mV relative to a standard Ag/AgCl reference electrode. We have found an ORP value of +550 to 1500 mV is typically needed for cleaning and a preferred range of +800 to 1200 mV can be used. We have found an important correlation between the oxidation-reduction potential of the active ozone composition containing solutions of the invention and the cleaning activity of the material. As the oxidation-reduction potential reaches about +600 mV (measured against a standard AgAgCl electrode) the cleaning capacity of the systems increases substantially.

Oxidation-reduction potential of these systems relates to the oxidizing strength of the active ozone materials in solution. In the chemical oxidation which underline the cleaning action of the active ozone compositions, chemical reactions occur in which electrons are given up by an oxidizing species which is then reduced while the target soil is oxidized by the cleaner. In any oxidation-reduction reaction, the oxidation and reduction parts of the reaction can be separated so that a theoretical current can be used to perform useful work. The current can be characterized having an electromotive force when compared to a standard electrode potential. The difference in electrical potential between the two electrodes depends on the equilibrium constant for the chemical reaction and the activities of the reactants and products. We have found that the measurement of potential or electromotive force can be used to characterize the cleaning capacity of the active ozone compositions in aqueous solution of this invention. Reference electrodes that can be used to measure the potential of the ozone solution include standard reference hydrogen electrodes (having a potential of 0.0 mV) and standard Ag/AgCl electrodes, also a reference electrode known as calomel electrode can be used. The hydrogen electrode relies on the $\frac{1}{2}H_2=H^++e^-$ half reaction. The standard Ag/AgCl electrode contains 1.0M KCl, relies on the $AgCl+e^-=Ag^\circ+Cl$ half reaction and has a reference potential of 0.22234 at 25° C. The calomel electrode consists of mercury in the bottom of a vessel with a paste of mercury and mercurous chloride (calomel) over it in contact with a solution of potassium chloride saturated with mercurous chloride. The calomel half reaction is $\frac{1}{2}Hg_2Cl_2+e^-=Hg^\circ+Cl^-$. The normal calomel electrode contains a molar solution of potassium chloride and has a reference potential of 0.2830 volts at 25° C. with reference to the standard hydrogen electrode. The measurements of the potential of the active ozone containing materials of the invention can be obtained using a procedure set forth in *Inorganic Chemistry an Advanced Textbook,* Thirald Moeller, J. A. Wiley and Sons, N.Y. (1952), a standard inorganic chemistry reference text disclosing oxidation-reduction measurements.

Ozone ($O_3$) is a reactive, strong oxidizing agent that eventually decomposes into oxygen. The presence of other compositions such as $O_2$, $OH^-$, $OH^-$ strong base hydroperoxide anion, etc. can mediate decomposition. Ozone is sparingly soluble in water. In an aqueous solution, the decomposition of ozone is much more rapid than in the gaseous state, and its decomposition is catalyzed by the hydroxide ion.

Ozone adds oxygen to double bonded olefins, forming ring structured ozonides, which through further oxidation split the rings to produce acids. Additionally, ozone can undergo electrophilic reactions with moieties having molecular sites of strong electronic density (e.g., —OR, —NR, —SR, and similar heteroatom containing functionalities; where R is a hydrogen, alkyl, aryl, alkylaryl, or other non-carbon atom). Ozone can also oxidize materials by a nucleophilic reaction on molecular sites which are electron deficient. Inorganic materials, especially reduced cations, are oxidized by ozone via electron transfer reactions. Finally, the by-products formed during alkaline decomposition of ozone (e.g., hydroperoxide radical, superoxide radical ion, oxonide radical ion, etc.) can produce unselective radical reactions with organic materials. We have found that ozone and its alkaline by-products react with and help remove soil by similar oxidation actions. The ozone solution or formulation is preferably used immediately after preparation. The preferred embodiment of the invention is combining a freshly generated ozone gas composition with an aqueous alkaline carrier solution and contacting the resultant ozone solution immediately on a soiled surfaces. The ozone in an alkaline solution can be potentiated by an effective concentration of a Lewis base.

For the purpose of this invention, cleaning can include the steps of a preclean step, a rinse, surface cleaning with chemicals, chemical rinse, neutralization, and sanitizing. A carrier solution is defined as an aqueous liquid preferably to which ozone can be added. The liquid acts as a carrier of ozone, transporting ozone to the application site for use as a cleaning agent. The invention is distinguished from the prior art disclosures through the use of ozone at an alkaline pH or by the incorporation of a Lewis base for an improved cleaning property which surprisingly potentiates activity for soil removal.

DETAILED DESCRIPTION OF THE INVENTION

Briefly, the invention relates to methods for cleaning and aqueous compositions used in methods of cleaning hard surfaces wherein the compositions contain alkaline aqueous ozone. The aqueous ozone compositions can be potentiated by a Lewis base. The cleaning materials of the invention show a surprising level of cleaning properties when used at a basic pH when compared to other cleaners and to cleaners using ozone at acidic to neutral pH's. Preferably, the pH of the materials are greater than 7.5 and most preferably greater than 8.5, but less than 13. The Lewis base potentiating compounds useful in the invention comprise a variety of chemical additive materials that can increase the cleaning effect of aqueous ozone solutions.

We have found that the cleaning effect of the ozonized cleaning solution improves as the pH increases. The cleaning action of the cleaning solution is further increased by the addition of a Lewis base into the cleaning solution. A Lewis base is a substance containing an atom capable of donating a pair of electrons to an acid.

Typically ozone can be added to an alkaline solution at a pH above 7.5. The aqueous solution can be made alkaline through the addition of a base. Such bases include alkaline metal hydroxides such as sodium hydroxide, potassium hydroxide, ammonium hydroxide, etc. An alkaline potentiator is a compound that can produce a pH greater than 7 when used in aqueous solution with ozone; or a neutral potentiator can be used at an alkaline pH which can be combined with ozone. These potentiator additives can be used along with, or in place of, the aforementioned hydroxide bases as long as they produce a pH greater than 7. Examples of such materials include alkaline metal carbonates such as sodium carbonate and potassium carbonate or their bicarbonates, and alkaline metal phosphates and alkaline metal silicates such as ortho or polyphosphates and ortho or polysilicates of sodium or potassium. These potentiators can be added as chemical adjuvants to the aqueous medium, or can come from natural sources such as mineral waters. Other examples of potentiators include hydrogen peroxide, and short-chain $C_{3-6}$ branched alcohols. Typically a pH of 7.5 would be effective for the cleaning effect of the ozonized cleaning solution. Preferably, a pH of higher than 8.5 can be used to lead to a better result. A pH greater than 13.5 is likely not to be effective. Most importantly, an oxidation potential of greater than +550 mV (relative to a Ag/AgCl reference electrode) is needed for cleaning at a pH within the effective range.

In aqueous ozone cleaners which comprise sodium or potassium hydroxide as the primary source of alkalinity, it has been found highly preferable to employ about 0.0025–3.0% of the basic materials.

The inorganic alkali content of the alkaline ozone cleaners of this invention is preferably derived from sodium or potassium hydroxide which can be derived from either liquid (about 10 to 60 wt-% aqueous solution) or solid (powdered or pellet) form. The preferred form is commercially-available aqueous sodium hydroxide, which can be obtained in concentrations of about 50 wt-% and in a variety of solid forms of varying particle size.

For many cleaning applications, it is desirable to replace a part or all of the alkali metal hydroxide with: (1) an alkali metal silicate or polysilicate such as anhydrous sodium ortho or metasilicate, (2) an alkali metal carbonate or bicarbonate such as anhydrous sodium bicarbonate, (3) an alkali metal phosphate or polyphosphate such as disodium monohydrogen phosphate or pentasodium tripolyphosphate. This can be done by the direct addition of these chemical adjuvants, or by use of natural waters containing these materials as natural minerals. When incorporated into the chemical composition within the preferred temperature ranges these adjuvants can act as an adjunct caustic agent, protect metal surfaces against corrosion, and sequester hardness metal ions in solution.

Sequestering agents can be used to treat hardness ions in service water, such ions include calcium, manganese, iron and magnesium ions in solution, thereby preventing them from interfering with the cleaning materials and from binding proteins more tightly to solid surfaces. Generally, a sequestrant is a substance that forms a coordination complex with a di or tri-valent metallic ion, thereby preventing the metallic ion from exhibiting its usual undesirable reactions. Chelants hold a metallic ion in solution by forming a ring structure with the metallic ion. Some chelating agents may contain three or four or more donor atoms that can coordinate simultaneously to hold a metallic ion. These are referred to as tridentate, tetradentate, or polydentate coordinators. The increased number of coordinators binding to a metallic ion increases the stability of the complex. These sequestrants include organic and inorganic and polymeric species.

In the present compositions, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 TO 2:1 and greater. Typical polyphosphates of this kind are the preferred sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

Sodium tripolyphosphate is the most preferred hardness sequestering agent for reasons of its ease of availability, low cost, and high cleaning power. Sodium tripolyphosphate (STPP) acts to sequester calcium and/or magnesium cations, providing water softening properties. STPP contributes to the removal of soil from hard surfaces and keeps soil in suspension. STPP has little corrosive action on common surface materials and is low in cost compared to other water conditioners. If an aqueous concentration of tripolyphosphate is desired, the potassium salt or a mixed sodium potassium system should be used since the solubility of sodium tripolyphosphate is 14 wt % in water and the concentration of the tripolyphosphate concentration must be increased using means other than solubility.

The ozone detergents can be formulated to contain effective amounts of synthetic organic surfactants and/or wetting agents. The surfactants and softeners must be selected so as to be stable and chemically-compatible in the presence of ozone and alkaline builder salts. One class of preferred surfactants is the anionic synthetic detergents. This class of synthetic detergents can be broadly described as the water-soluble salts, particularly the alkali metal (sodium, potassium, etc.) salts, or organic sulfuric reaction products having in the molecular structure an alkyl radical containing from about eight to about 22 carbon atoms and a radical selected from the group consisting of sulfonic acid and sulfuric acid ester radicals.

Preferred anionic organic surfactants contain carboxylates, sulfates, phosphates (and phosphonates) or sulfonate groups. Preferred sulfates and sulfonates include alkali metal (sodium, potassium, lithium) primary or secondary alkane sulfonates, alkali metal alkyl sulfates, and mixtures thereof, wherein the alkyl group is of straight or branched chain configuration and contains about nine to about 18 carbon atoms. Specific compounds preferred from the standpoints of superior performance characteristics and ready availability include the following: sodium decyl sulfonate, sodium dodecyl sulfonate, sodium tridecyl sulfonate, sodium tetradecyl sulfonate, sodium hexadecyl sulfonate, sodium octadecyl sulfate, sodium hexadecyl sulfate and sodium tetradecyl sulfate. Carboxylate surfactants can also be used in the materials of the invention. Soaps represent the most common of commercial carboxylates. Additional carboxylate materials include alphasulfocarboxylic acid esters, polyalkoxycarboxylates and acyl sarcocinates. The mono and diesters and orthophosphoric acid and their salts can be useful surfactants. Quaternary ammonium salt surfactants are also useful in the compositions of the invention. The quaternary ammonium ion is a stronger hydrophile than primary, secondary or tertiary amino groups, and is more stable to ozonolysis. Preferred quaternary surfactants include substantially those stable in contact with ozone including $C_{6-24}$ alkyl trimethyl ammonium chloride, $C_{8-10}$ dialkyl dimethyl ammonium chloride, $C_{6-24}$ alkyl-dimethylbenzyl ammonium chloride, $C_{6-24}$ alkyl-dimethyl amine oxides, $C_{6-24}$ dialkyl-methyl amine oxides, $C_{6-24}$ trialkyl amine oxides, etc.

Nonionic synthetic surfactants may also be employed, either alone or in combination with anionic and cationic types. This class of synthetic detergents may be broadly defined as compounds produced by the condensation of alkylene oxide or polyglycoside groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water soluble or dispersible compound having the desired degree of balance between hydrophilic and hydrophobic elements.

For example, a well-known class of nonionic synthetic detergents is made available on the market under the trade name of "Pluronic". These compounds are formed by condensing ethylene oxide with a hydrophobic base formed by the condensation of propylene oxide with propylene glycol. The hydrophobic portion of the molecule has a molecular weight of from about 1,000 to 1,800. The addition of polyoxyethylene radicals to this hydrophobic portion tends to increase the water solubility of the molecule as a whole and the liquid character of the products is retained up to the point where the polyoxyethylene content is about 50 percent of the total weight of the condensation product. Another example of nonionic detergents with noted stability during the cleaning procedure are the class of materials on the market under the tradename of APG-polyglycosides. These nonionic surfactants are based on glucose and fatty alcohols.

Other suitable nonionic synthetic detergents include the polyalkylene oxide condensates of alkyl phenols, the products derived from the condensation of ethylene oxide or propylene oxide with the reaction product of propylene oxide and ethylene diamine, the condensation product of aliphatic fatty alcohols with ethylene oxide as well as amine oxides and phosphine oxides.

Ozone cannot be easily stored or shipped. Ozone is typically generated on site and dissolved into aqueous medium at the use locus just prior to use. Within practical limits, shortening the distance between points of generation and use reduce the decomposition loss of the concentration of ozone in the material. The half life of ozone in neutral solutions is on the order to 3–10 minutes and less as pH increases. Weak concentrations of ozone may be generated using ultraviolet radiation. Typical production of ozone is made using electrical corona discharge. The process involves the case of a source of oxygen in a pure $O_2$ form, generally atmospheric oxygen (air), or enriched air. The source of $O_2$ is passed between electrodes across which a high voltage alternating potential is maintained. The electrodes are powered from a step transformer using service current. The potential is established across the electrodes which are configured to prevent arcing. As oxygen molecules enter the area of the potential, a corona is created having a proportion of free atomic oxygen ions from dissociated $O_2$. The high energy atomic ions (O) when combined with oxygen ($O_2$) form a mixture of oxygen and ozone. These generators are available commercially. The ozone containing gaseous mixture is generally directly contacted with an aqueous solution through bubbling or other gas dispersion techniques to introduce a concentration of ozone into the aqueous medium. The contact between ozone and the aqueous medium is engineered to maximize the absorption of ozone when compared to the rate of decomposition of ozone in the alkaline aqueous medium and the required ozone concentration of the water.

The activity of ozone in the materials of the invention can be improved by introducing ozone into the smallest possible diameter bubble formation. Small bubbles promote the mass transfer of ozone into aqueous solution. Additionally, surface active agents which lower the gas-liquid interfacial tension can be used to enhance ozone gas transport to the aqueous medium. Rapid dissolution of ozone can reduce the tendency to off gas, and cause reactions with solution components to produce oxidized species and promote the effective use of ozone. Alternately, the $O_3$ can be produced using ultraviolet light or combinations of these methods. Neutral aqueous solutions have a small but measurable solubility of ozone at various temperatures; these are:

| Temperature | Ozone Concentration |
|---|---|
| 0° C. | 35 (ppm) |
| 20° C. | 21 |
| 40° C. | 4 |
| 60° C. | 0 |

The stability of ozone in aqueous solution decreases as alkalinity rises. The half life of ozone in 1N sodium hydroxide is <10 seconds. For the purpose of the invention involving concentrations of ozone in aqueous solution, the term "total ozone" relates to the amount of ozone added to the aqueous phase from the gas phase. Typically, these "total ozone" levels in the gas phase are 0.1–3.0 wt %. "Measured ozone" is the apparent concentration of ozone (as $O_3$) in aqueous solution. These aqueous levels are about 0.1–22.2 mg/L (ppm). The difference between total ozone and measured ozone relates to an amount of ozone that apparently becomes stored in aqueous solution by reaction with inorganic species to form ozonized or oxidized inorganic materials, e.g., hydroxyl radicals, ozonide radical ion, superoxide radical ion, etc. Such oxidized materials tend to be a source of oxidizing potential. We have found that the cleaning power of the materials of the invention relate to the presence of free solubilized "measured" ozone species and the presence of species that can act as oxidizing agents created in-situ by the reaction of ozone with materials in solution. The term "active" ozone composition refers to the total concentration of oxidizing species (organic and inorganic) produced by introducing ozone into the formulated cleaners of the invention. The term "initial ozone" means the measured concentration of ozone immediately after introduction of ozone into the aqueous solution. The difference between initial ozone and measured ozone relates to timing of the measurement. Measured ozone is the concentration of ozone in solution measured at any time after an initial value is found.

In aqueous cleaning compositions using ozone, the concentration of the ozone, and oxidizing ozone by-products, should be maintained as high as possible to obtain the most active cleaning and antimicrobial properties. Accordingly, a concentration as high as 23 parts by weight of ozone per million parts of total cleaning solution is a desirable goal. Due to the decomposition of ozone and the limited solubility of ozone in water, the concentration of the materials commonly fall between about 0.1 and 10 parts of ozone per million parts of aqueous cleaning solution, and preferably from about 1.0 to about 5 parts per million of ozone in the aqueous material. The oxidizing potential of this solution, as measured by a standard, commercially available, ORP (oxidation-reduction potential) probe, is between +350 and 1500 mV (as referenced to a standard Ag/AgCl electrode), and is dependent on the pH of the solution. Most importantly, an ORP greater than +550 mV is necessary for proper cleaning.

The Lewis base additive materials used in the invention to potentiate the action of ozone can be placed into the water stream into which ozone is directed for preparing the ozone materials or can be post added to the aqueous stream.

The total concentration of ozone potentiators used in the use solution containing ozone can range from about 10 parts per million to about 3000 parts per million (0.3 wt %). The material in use concentrations typically fall between 50 and 3000 parts per million, and preferably 300– 1000 ppm of the active ozone potentiators in the aqueous cleaning solutions. In the preferred ozone containing aqueous systems of the invention, inorganic potentiators are preferred due to the tendency of organic materials to be oxidized by the active ozone containing materials.

In use the aqueous materials are typically contacted with soiled target surfaces. Such surfaces can be found on exposed environmental surfaces such as tables, floors, walls, can be found on ware including pots, pans, knives, forks, spoons, plates, dishes, food preparation equipment; tanks, vats, lines, pumps, hoses, and other process equipment. One preferred application of the materials of the invention relates to dairy processing equipment. Such equipment are commonly made from glass or stainless steel. Such equipment can be found both in dairy farm installations and in dairy plant installations for the processing of milk, cheese, ice cream or other dairy products.

The ozone containing aqueous cleaning material can be contacted with soiled surfaces using virtually any known processing technique. The material can be sprayed onto the surface, surfaces can be dipped into the aqueous material, the aqueous cleaning material can be used in automatic warewashing machines or other batch-type processing. A preferred mode of utilizing the aqueous ozone containing materials is in continuous processing, wherein the ozone containing material is pumped through processing equipment and CIP (clean in place) processing. In such processing, an initial aqueous rinse is passed through the processing equipment followed by a sanitizing cleaning using the potentiated ozone containing aqueous materials. The flow rate of the material through the equipment is dependent on the equipment configuration and pump size. Flow rates on the order of 10 to 150 gallons per minute are common. The material is commonly contacted with the hard surfaces at temperatures of about ambient to 70° C. We have found that to achieve complete sanitizing and cleaning that the material should be contacted with the soiled surfaces for at least 3 minutes, preferably 10 to 45 minutes at common processing pressures.

We have found that combining ozone with a Lewis base in an aqueous solution at a pH greater than 7, preferably greater than 8, results in surprisingly improved cleaning properties. A variety of available detergent components have been found that potentiate the effectiveness of ozone in cleaning surfaces and in particular removing proteinaceous soils from hard surfaces. The results are surprising in view of the fact that substantially complete cleaning has resulted at conditions including room temperature (74° F.), 10 minute contact time and moderate pH's ranging between 8 and 13 (U.S. typical CIP programs of 160° F., 30–40 minutes, a pH greater than 12, and hypochlorite greater than 100 ppm). In all the systems studied, raising the pH from 8 to 13 can greatly enhance the cleaning effect. This effect is clearly shown in Examples 1–8.

The data in the Examples were obtained in experiments we performed that demonstrate the effectiveness of ozonized solutions as cleaning agents. Polished 304 stainless steel coupons of sizes 3"×5" and 1"×3" were cleaned according to a standard CIP protocol for the data generated. The following cleaning protocol was used. New stainless steel surfaces were treated by first rinsing the steel in 100°– 115° F. water for 10 minutes. The rinsed surfaces were washed in an aqueous composition containing vol % of a product containing 0.28% cellosize, 6% linear alkyl benzene sulfonate (60 wt % aqueous active), sodium xylene sulfonate (40 wt % aqueous active), ethylene diamine tetraacetic acid (40 wt % aqueous active), 6% sodium hydroxide, 10 wt % propylene glycol methyl ether (the balance of water). Along with 1.5 vol % of an antifoam solution comprising 75 wt % of a benzylated polyethoxy polypropoxy block copolymer and 25 wt % of a nonyl phenol alkoxylate wherein the alkoxylate moiety contains 12.5 mole % ethylene oxide and 15 mole % propylene oxide. After washing the surfaces at 110°–115° F. for 45 minutes, the surfaces are rinsed in cold water and passivated by an acid wash in a 54% by volume solution of a product containing 30 wt % of phosphoric acid (75 wt % active aqueous) and 34% nitric acid (42° baume). After contact with the acid solution, the coupons are rinsed in cold water.

The cleaned coupons were then immersed in cold (40° F.) milk while the milk level was lowered at a rate of 4 feet per hour by draining the milk from the bottom. The coupons were then washed in a consumer dishwasher under the following conditions:

Cleaning cycle: 100° F., 3 minutes, using 10 gallons of city water containing by weight 60 ppm Calcium and 20 ppm Magnesium (both as chloride salt) and 0.26% of the detergent Principal with a reduced level (30 ppm) of sodium hypochlorite.

Rinsing cycle: 100° F., 3 minutes, using 10 gallons of city water.

The procedure of soiling and washing was repeated for 20 cycles. The films produced after the 20 cycles were characterized to verify the presence of protein on the coupons. Reflectance infrared spectra showed amide I and amide II bands, which are characteristic of proteinaceous materials. Scanning electron microscope photomicrographs showed greater intensity of soiling along the grains resulted from polishing. Energy Dispersive X-ray Fluoresenic Spectroscopy, EDS, showed the presence of carbon and oxygen, indicative of organic materials. Staining with Coomassie Blue gave a blue color, typical of a proteinaceous material.

These soils were demonstrated to be tenacious soils. A typical cleaning regimen could not remove the soil. A severe cleaning protocol could remove the soil. As a control, spot testing and washing the coupons showed that washing for 3 minutes in a dishwasher at 100° F. with 0.4% Principal (2000 ppm of sodium hydroxide, 2000 ppm of sodium tripolyphosphate, and 200 ppm of sodium hypochlorite) did not produce any substantial cleaning effect. As a further control, in more severe cleaning conditions such as 1% Principal for 90 minutes appeared to be effective in cleaning the soil film.

In addition, protein soiled coffee cups were obtained from a restaurant. Infrared spectra, scanning electron microscopy (SEM) and Coomassie Blue staining were used to characterize the soils. A similar cleaning protocol as above demonstrated the tenacity of the film and little soil removal was found in 10 minutes of cleaning. The SEM pictures after cleaning with hypochlorite solutions showed the soil was not removed, but merely bleached to lose visible coloration.

Protein Cleaning Procedure

The cleaning procedure utilizing ozone is described in the following:

Ozone is generated through electrical discharges in air or oxygen. An alternate method would be to generate the ozone with ultraviolet light, or by a combination of these methods. The generated ozone, together with air, is injected through a hose into a carrier solution, which might be either a buffered, or unbuffered, alkaline aqueous medium or a buffered, or unbuffered, aqueous medium containing the ozone potentiator. The injection is done using either an in-line mixing eductor, or by a contact tower using a bubble diffusion grid; however, any type of gas-liquid mixer would work as well. A continuous monitor of the level of oxidation power of the solution is performed using a conventional ORP (oxidation-reduction potential) probe; the solution was typically mixed with ozone until the ORP reading reached +550 mV relative to a standard Ag/AgCl reference electrode. Additionally, samples can be drawn and measured by traditional analytical techniques for determining aqueous ozone concentrations. The solution can be pumped directly to the spray site with the gas, or to a holding tank where the activated liquid is bled off and sprayed, or poured, onto the surfaces of coupons to be cleaned. Both processes were used successfully, and a pump can be used to drive the cleaning solution through a nozzle to form a spray. The operational parameters are variable, but the ones most typically used are: gas flow rate of 20–225 SCFH, a liquid pumping rate of 0.075–3 gal/min, temperatures of 50°–100° F., pH's of 7.5 to 13.5, spraying times of 0–30 minutes and an ORP of +550 to 1500 mV. These parameters are scaleable to greater or lesser rates depending on the scale of the system to be cleaned. For example, longer cleaning times (35–60 minutes) can be used when lower levels of aqueous ozone are employed. As a control, air—without ozone—was injected into the solutions listed as non-ozone (air) studies.

After cleaning, the cleanliness of the coupons were evaluated by a visual inspection, reflectance measurements, infrared spectrometry, and dyeing with Coomassie Blue (a protein binding dye).

By visual inspection the soiled stainless steel coupons are seen to have a yellow-bluish to brownish decolorization, with considerable loss in reflection. When cleaned the coupons become very reflective and the off colorization is removed.

Reflectance is a numerical representation of the fraction of the incident light that is reflected by the surface. These measurements were done on a Hunter Ultrascan Sphere Spectrocolorimeter (Hunter Lab). Cleanliness of the surface is related to an increase in the L-value (a measurement of the lightness that varies from 100 for perfect white to 0 for black, approximately as the eye would evaluate it, and the whiteness index (WI) (a measure of the degree of departure of an object from a 'perfect' white). Both values have been found as very reproducible, and numerically representative of the results from visual inspection. Consistently it is found that a new, passivated, stainless steel coupon has an L value in the range of 75–77 (usually 76±1), and a WI value of 38–42 (usually 40±1). After soiling with the aforementioned protein soiling process, the L value is about 61 and the WI around 10). It is shown that effective and complete cleaning will return the L and WI values to those at, or above, the new coupon values. Lack of cleaning, or removal to intermediate levels, gave no, to intermediate, increases in the reflectance values, respectfully.

Infrared chemical analysis using grazing angles of reflection were used to verify the presence (during the soiling process), and removal (during the cleaning process), of proteins from the surfaces. The IR data for a typical soiled coupon was found to have an amide-I carbonyl band of greater than 30 milli-Absorbance (mA) units, while an 80% cleaned sample (determined via reflectometry) would be much less than 5 units. Further removal to 95% dropped the IR absorption to less than 1 mA unit. Accordingly, the data verifies the removal of the protein, rather than mere bleaching and decolorization of the soil.

The Coomassie Blue dyeing is a recognized qualitative spot test for the presence of proteinaceous material. Proteinaceous residue on a surface of an item shows up as a blue color after being exposed to the dye, while clean surfaces show no retention of the blue coloration.

Examples of Ozone Cleaning

The experimental data of Tables 1–8 demonstrates the cleaning effect of ozone. Generally the effectiveness of a cleaning process depends on the pH and ORP values of the cleaning solution. The following examples are illustrations of the patent, and are not to be taken as limiting the scope of the application of the patent. Generally conditions leading to higher amounts of ozone, or any ozone-activated species, as measured by an ORP probe reading, exposure at the cleaning site gave better results; i.e., high fluid flow rates, increased reaction times, high potentiator levels, etc.

EXAMPLE 1

Effects Of pH On Cleaning

The effect of pH on air and ozone cleaning, of proteinaceous soils, are shown in Table 1. The results demonstrate that the protein soil is not easily removed by the mere addition of air, as the control gas-additive, and typically less than 15% of the soil is removed under any of the experimental conditions (see Table 1, rows 1–13). In contrast to air cleaning, ozone injected under low-to-high (25–10,000 ppm metal hydroxide) alkaline conditions is very effective at protein soil removal under a variety of experimental conditions, yielding relatively high levels of cleaning (see Table 1, rows 19–31); i.e., greater than 95% protein soil removal can be obtained with ozone present when using an assortment of variable experimental conditions including spray time, liquid flow rate, pH, and liquid phase ozone concentration. Generally when ozone is present, many combinations of these conditions will lead to effective soil removal, and increasing any of these aforementioned variables tends to enhance the cleaning. For example, the effect of increasing the liquid spray flow rate and time, on soil removal, is demonstrated by comparing rows 19 and 20, or rows 25–27. By contrast, these variables have little effect when ozone is absent and only air is injected.

The data also demonstrates the lack of effectiveness of ozone for protein soil removal when the pH is at, or below, a pH of 7 (see Table 1, rows 14–18). This is remarkable since acidic conditions are known to favor the stability of ozone in solution, and give a larger oxidation/reduction potential than ozone under alkaline conditions; however, acidic conditions do not appear to favor the protein cleaning power of the mixture. Conversely, the cleaning capacity is enhanced under conditions where ozone is known to be less stable (i.e., alkaline conditions, with the presence of hydroxide ions) and possesses a lower oxidation potential, thus, demonstrating the non-obviousness of the invention.

EXAMPLE 2

Effects Of Lewis Base Examples On Cleaning

Table 2 illustrates the effect of various Lewis base, pH-increasing, additives on air and ozone cleaning of the proteinaceous soil. This group is selected from the alkali metal hydroxides, alkali metal silicates (or polysilicates), alkali metal phosphates (or polyphosphates), alkali metal borates, and alkali metal carbonates (or bicarbonates), or combinations thereof. The results demonstrate that the protein soil is not easily removed (usually less than 10%) by these additives when air is added to the system (rows 6, 11, 16, 19, 25); however, when ozone is injected (rows 1–5, 7–10, 12–15, 17–18, 20–24, 26– 31) these adjuvants are quite effective in assisting protein soil removal, even under alkaline conditions (pH's 8–13) which a skilled artisan would be directed away from in prior art disclosures. Of special novel significance are the studies which allow for very effective soil removal under relatively mild alkalinity (a pH between 8–10) CIP cleaning conditions (e.g. the tripoly system at about pH=9 in lines 7–11, the bicarbonate system at about pH=7.0 in lines 20–27, and the borate system at pH's 7–9 in lines 28– 31).

EXAMPLE 3

Effects Of Sodium Bicarbonate

Table 3 exemplifies the cleaning effect of the Lewis base, sodium bicarbonate, which is naturally present from mineral water (present at 244 ppm in the experiments of Table 3). This data for comparison to making adjuvant additions from commercial chemical sources, and demonstrates the ability to remove proteinaceous soils using ozone and water containing inherent levels of ozone-potentiating Lewis bases. These natural levels of minerals can be used in place of, or as an additive to, the protein cleaning processes using adjuvant levels of chemical mixtures. The data also indicates that the bicarbonate system has an effective cleaning range between pH's of about 8 and 10, with reduced cleaning properties outside these ranges.

EXAMPLE 4

Oxidation-Reduction Potential And Cleaning

Table 4 exemplifies the cleaning effect in relationship to oxidation-reduction potential (ORP). The data demonstrates the ability to remove proteinaceous soils, using a variety of ozone solutions with a pH greater than 7, when an ORP reading of greater than 750 milli-volts is obtained (lines 8–17). Conversely, much lower levels of cleaning are found below this OEP (lines 1–7), where soil removal value similar to the control air study (line 1) are obtained. These examples teach the application of using ORP readings to evaluate the cleaning potential of an ozonated solution.

EXAMPLE 5

Residence Time And Cleaning

Table 5 illustrates the effect of cleaning ability, of an ozonated solution, over distance and time; i.e., the effect of various residence times in the tubing before reaching the cleaning point. The increase in residence time was done by sequentially increasing the distance between the CIP holding tank containing the ozonated solution and the contact site where the ozonated solution is employed for cleaning. The data exemplifies the ability to pump ozonated cleaning solutions to remote locations, and with common residence times (60–120 seconds) found in typical CIP de-soiling operations, with no apparent degradation in the cleaning capacity of the system. The data illustrates the novel ability to stabilize, and utilize, alkaline ozone solutions for removing proteinaceous soils. These results establish the novelty of the invention in contrast to prior art disclosures which direct the skilled artisan away from alkaline cleaning compositions.

EXAMPLE 6

Effects Of A Lewis Base On Cleaning

Table 6 illustrates the effect of various Lewis base additives (under pH buffered conditions) on air and ozone cleaning of the proteinaceous soil. As with previous examples, the injection of air as a control study led to little or no cleaning (see Table 6, rows 1, 2, 5, 8, 11, 15, 19, 22, 25, 28). In contrast, when ozone is injected (rows 3–4, 6–7, 9–10, 12–14, 16–18, 20–21, 23–24, 26, 28– 29) these bases, at levels as low as 50 ppm, can be quite effective at protein soil removal; even if the system is buffered to relatively low pH's (8.0 and 10.3) as compared to typical CIP cleaning. It is also shown that the soil elimination typically increases with increasing adjuvant level (cf., rows 6 and 7, 12 to 14, 23 and 24). Also, as before, an elevated pH leads to enhanced protein removal (cf., rows 3 and 4, 7 and 10, 14 and 18, 21 and 24, 26 and 28). One adjuvant that is especially noteworthy is the bicarbonate system (rows 5–10), where exceptional cleaning was even found at the low pH (8.0) level. Additionally, these additives give a greater, than mere additive, effect on cleaning. This non-obvious performance is demonstrated by the following examples: rows 3 (ozone alone) +5 (adjuvant alone) is less than row 7 (ozone + adjuvant), or rows 4+8<row 10, or rows 4+15<row 18, etc.

EXAMPLE 7

Effects Of A Surfactant On Cleaning

Table 7 illustrates the effect of various organic surfactants on ozone cleaning of the proteinaceous soil. The results demonstrate that common surfactants can be used with the ozone cleaning procedure without a negative detriment to soil removal and, actually, some give slight positive results to the elimination.

EXAMPLE 8

Cleaning Ceramic-Glass

Table 8 illustrates the effect of cleaning ability, of an ozonated solution, for removing proteinaceous soil from a ceramic-glass surface. The data demonstrates the ability to remove soil from hard surfaces other than stainless steel (liens 2 and 4), and also the lack of removal when ozone is not present (lines 1 and 3).

TABLE 1

THE EFFECT OF METAL HYDROXIDES AND OZONE ON PROTEIN REMOVAL FROM STAINLESS STEEL

| Conditions[1] | Gas | Spray Time (minutes) | Liquid Flow Rate (gal/min) | NaOH Conc. (ppm) | KOH Conc. (ppm) | pH | Delta L-value[2] | Delta Whiteness Index (WI)[3] | % Soil Removal[4] |
|---|---|---|---|---|---|---|---|---|---|
| A) non ozone studies | | | | | | | | | |
| 1 moderate acidity | air | 10 | 1.00 | — | — | 2.3[5] | 4.5 | −0.4 | 0.0% |
| 2 low acidity | air | 10 | 1.00 | — | — | 5.3[5] | 5.8 | 4.0 | 11.4% |
| 3 neutral | air | 10 | 1.00 | — | — | 7.0 | 6.1 | 3.2 | 9.1% |
| 4 neutral | air | 10 | 0.50 | — | — | 7.4 | −0.06 | −0.5 | 0.0% |
| 5 low alkaline | air | 10 | 0.50 | 25 | — | 8.7 | 0.2 | 1.5 | 4.3% |
| 6 moderate alkaline | air | 10 | 0.50 | 250 | — | 10.8 | 1.2 | 5.3 | 15.1% |
| 7 moderate alkaline | air | 10 | 0.50 | 500 | — | 11.3 | 0.7 | 3.9 | 11.1% |
| 8 moderate alkaline | air | 10 | 1.00 | 500 | — | 12.2 | 5.5 | 3.7 | 10.6% |
| 9 high alkaline | air | 20 | 0.21 | — | 1000 | 12.2 | −0.5 | 3.3 | 9.4% |
| 10 high alkaline | air | 10 | 0.50 | 1000 | — | 12.3 | 1.5 | 5.3 | 15.1% |
| 11 high alkaline | air | 10 | 1.00 | 1000 | — | 12.4 | 3.7 | 1.2 | 3.4% |
| 12 high alkaline | air | 10 | 1.00 | 5000 | — | 13.2 | 3.5 | 4.3 | 12.3% |
| 13 high alkaline | air | 10 | 1.00 | 10000 | — | 13.3 | 3.0 | 4.5 | 12.9% |
| B) ozone studies | | | | | | | | | |
| 14 moderate acidity | $O_3$ | 10 | 0.31 | — | — | 2.1[6] | 4.0 | 2.2 | 6.3% |
| 15 moderate acidity | $O_3$ | 10 | 1.00 | — | — | 2.3[5] | 2.0 | −4.4 | 0.0% |
| 16 low acidity | $O_3$ | 10 | 1.00 | — | — | 5.3[5] | 6.2 | 2.1 | 6.0% |
| 17 neutral | $O_3$ | 10 | 1.00 | — | — | 7.0 | 4.3 | −2.8 | 0.0% |
| 18 neutral | $O_3$ | 10 | 0.50 | — | — | 7.4 | −0.1 | −0.5 | 0.0% |

TABLE 1-continued

THE EFFECT OF METAL HYDROXIDES AND OZONE ON PROTEIN REMOVAL FROM STAINLESS STEEL

| Conditions[1] | Gas | Spray Time (minutes) | Liquid Flow Rate (gal/min) | NaOH Conc. (ppm) | KOH Conc. (ppm) | pH | Delta L-value[2] | Delta Whiteness Index (WI)[3] | % Soil Removal[4] |
|---|---|---|---|---|---|---|---|---|---|
| 19 low alkaline | $O_3$ | 10 | 0.50 | 25 | — | 8.7 | 3.9 | 11.3 | 32.3% |
| 20 low alkaline | $O_3$ | 15 | 1.00 | 25 | — | 8.5 | 16.7 | 34.5 | 98.6% |
| 21 low alkaline | $O_3$ | 10 | 0.50 | 50 | — | 9.3 | 3.7 | 11.0 | 31.4% |
| 22 low alkaline | $O_3$ | 10 | 0.50 | 150 | — | 10.0 | 3.9 | 12.1 | 34.6% |
| 23 moderate alkaline | $O_3$ | 10 | 0.50 | 250 | — | 10.8 | 4.2 | 16.7 | 47.7% |
| 24 moderate alkaline | $O_3$ | 10 | 0.50 | 500 | — | 11.3 | 6.9 | 26.5 | 75.7% |
| 25 high alkaline | $O_3$ | 20 | 0.08 | — | 1000 | 12.2 | 1.0 | 3.5 | 10.0% |
| 26 high alkaline | $O_3$ | 20 | 0.21 | — | 1000 | 12.2 | 14.7 | 33.5 | 95.7% |
| 27 high alkaline | $O_3$ | 20 | 0.99 | — | 1000 | 12.2 | 17.1 | 34.9 | 99.7% |
| 28 high alkaline | $O_3$ | 10 | 0.50 | 1000 | — | 12.3 | 7.3 | 27.1 | 77.4% |
| 29 high alkaline | $O_3$ | 10 | 0.50 | 1500 | — | 12.4 | 6.5 | 25.5 | 72.9% |
| 30 high alkaline | $O_3$ | 10 | 1.00 | 5000 | — | 13.2 | 11.5 | 29.9 | 85.4% |
| 31 high alkaline | $O_3$ | 10 | 1.00 | 10000 | — | 13.3 | 15.3 | 28.9 | 82.6% |

[1]Experimental: ozone was generated at a rate of: air flow = 40 SCFH, 15 psi, 6.3 amps, and injected into water at a temperature = 74° F., with a variable spray rate and reaction time.
[2]Delta L = ending L value of cleaned coupon minus starting L value of soiled coupon.
[3]Delta WI = ending WI value of cleaned coupon minus starting WI value of soiled coupon.
[4]% Soil Removal = 100 × [delta WI/(avg. cleaned WI − avg. soiled WI)] = 100 × [(delta WI)/(40 − 5)].
[5]pH adjusted with $H_2SO_4$.
[6]pH adjusted with $H_3PO_4$.

TABLE 2

THE EFFECT OF VARIOUS LEWIS BASES AND OZONE ON PROTEIN REMOVAL FROM STAINLESS STEEL

| Conditions[1] | Gas | Reaction Time (minutes) | NaOH Conc. (ppm) | $Na_4SiO_4$ Conc. (ppm) | $Na_5P_3O_{10}$ Conc. (ppm) | $Na_2CO_3$ Conc. (ppm) | $NaHCO_3$ Conc. (ppm) | $Na_3BO_3$ Conc. (ppm) | pH | Delta L-value[2] | % Soil Removal[3] |
|---|---|---|---|---|---|---|---|---|---|---|---|
| 1 sodium orthosilicate | $O_3$ | 10 | 0 | 250 | 0 | 0 | 0 | 0 | 9.4 | 11.9 | 86.6% |
| 2 sodium orthosilicate | $O_3$ | 10 | 0 | 500 | 0 | 0 | 0 | 0 | 9.7 | 14.1 | 78.5% |
| 3 sodium orthosilicate | $O_3$ | 10 | 0 | 1000 | 0 | 0 | 0 | 0 | 11.1 | 12.7 | 74.8% |
| 4 sodium orthosilicate | $O_3$ | 10 | 0 | 5000 | 0 | 0 | 0 | 0 | 13.2 | 15.3 | 92.1% |
| 5 sodium orthosilicate | $O_3$ | 10 | 0 | 10000 | 0 | 0 | 0 | 0 | 13.4 | 17.6 | 100.2% |
| 6 sodium orthosilicate | air | 10 | 0 | 10000 | 0 | 0 | 0 | 0 | 13.5 | 0.6 | 4.7% |
| 7 sodium tripoly-phosphate | $O_3$ | 10 | 0 | 0 | 500 | 0 | 0 | 0 | 9.1 | 10.4 | 80.4% |
| 8 sodium tripoly-phosphate | $O_3$ | 10 | 0 | 0 | 1000 | 0 | 0 | 0 | 9.1 | 13.0 | 101.8%[4] |
| 9 sodium tripoly-phosphate | $O_3$ | 10 | 0 | 0 | 5000 | 0 | 0 | 0 | 9.2 | 12.9 | 101.5%[4] |
| 10 sodium tripoly-phosphate | $O_3$ | 10 | 0 | 0 | 10000 | 0 | 0 | 0 | 9.2 | 13.2 | 102.6%[4] |
| 11 sodium tripoly-phosphate | air | 10 | 0 | 0 | 10000 | 0 | 0 | 0 | 9.2 | 0.1 | 1.1% |
| 12 sodium carbonate | $O_3$ | 10 | 0 | 0 | 0 | 500 | 0 | 0 | 10.2 | 11.6 | 94.1% |
| 13 sodium carbonate | $O_3$ | 10 | 0 | 0 | 0 | 1000 | 0 | 0 | 10.3 | 9.8 | 80.0% |
| 14 sodium carbonate | $O_3$ | 10 | 0 | 0 | 0 | 5000 | 0 | 0 | 10.8 | 10.4 | 84.3% |
| 15 sodium carbonate | $O_3$ | 10 | 0 | 0 | 0 | 10000 | 0 | 0 | 11.0 | 12.2 | 98.4% |
| 16 sodium carbonate | air | 10 | 0 | 0 | 0 | 10000 | 0 | 0 | 11.1 | 3.1 | 24.6% |
| 17 sodium hydroxide | $O_3$ | 10 | 5000 | 0 | 0 | 0 | 0 | 0 | 13.2 | 11.5 | 85.6% |
| 18 sodium hydroxide | $O_3$ | 10 | 10000 | 0 | 0 | 0 | 0 | 0 | 13.3 | 15.3 | 92.5% |
| 19 sodium hydroxide | air | 10 | 10000 | 0 | 0 | 0 | 0 | 0 | 13.3 | 3.0 | 20.8% |
| 20 sodium bicarbonate | $O_3$ | 30 | 0 | 0 | 0 | 0 | 25 | 0 | 7.7 | 4.3 | 34.4% |
| 21 sodium bicarbonate | $O_3$ | 30 | 0 | 0 | 0 | 0 | 50 | 0 | 7.8 | 3.2 | 25.0% |
| 22 sodium bicarbonate | $O_3$ | 30 | 0 | 0 | 0 | 0 | 100 | 0 | 8.2 | 10.3 | 80.3% |
| 23 sodium bicarbonate | $O_3$ | 30 | 0 | 0 | 0 | 0 | 250 | 0 | 8.4 | 13.9 | 88.8% |
| 24 sodium bicarbonate | $O_3$ | 30 | 0 | 0 | 0 | 0 | 1000 | 0 | 8.6 | 12.2 | 99.1% |
| 25 sodium bicarbonate | air | 30 | 0 | 0 | 0 | 0 | 1000 | 0 | 8.7 | 0.5 | 3.4% |
| 26 sodium bicarbonate | $O_3$ | 30 | 0 | 0 | 0 | 0 | 1000 | 0 | 7.5 | 12.7 | 101.3% |
| 27 sodium bicarbonate | $O_3$ | 30 | 0 | 0 | 0 | 0 | 2000 | 0 | 6.5 | 13.7 | 102.9% |
| 28 sodium borate | $O_3$ | 30 | 0 | 0 | 0 | 0 | 0 | 1225 | 7.0[5] | 3.9 | 28.1% |
| 29 sodium borate | $O_3$ | 30 | 0 | 0 | 0 | 0 | 0 | 1225 | 8.0[5] | 3.1 | 24.0% |
| 30 sodium borate | $O_3$ | 30 | 0 | 0 | 0 | 0 | 0 | 1225 | 9.0[5] | 9.8 | 82.7% |
| 31 sodium borate | $O_3$ | 30 | 0 | 0 | 0 | 0 | 0 | 1225 | 10.0[5] | 8.2 | 64.6% |

[1]Experimental: ozone was generated at a rate of: air flow = 40 SCFH, 15 psi, 6.3 amps, and injected into water at a temperature = 74° F., with a spray flow of 1.0 gal/min, and a reaction time of 10 minutes.
[2]Delta L = ending L value of cleaned coupon minus starting L value of soiled coupon.
[3]Delta WI = ending WI value of cleaned coupon minus starting WI value of soiled coupon.

TABLE 2-continued

THE EFFECT OF VARIOUS LEWIS BASES AND OZONE ON PROTEIN REMOVAL FROM STAINLESS STEEL

| Conditions[1] | Gas | Reaction Time (minutes) | NaOH Conc. (ppm) | $Na_4SiO_4$ Conc. (ppm) | $Na_5P_3O_{10}$ Conc. (ppm) | $Na_2CO_3$ Conc. (ppm) | $NaHCO_3$ Conc. (ppm) | $Na_3BO_3$ Conc. (ppm) | pH | Delta L-value[2] | % Soil Removal[3] |
|---|---|---|---|---|---|---|---|---|---|---|---|

[4]% Soil Removal = 100 × [delta WI/(avg. cleaned WI − avg. soiled WI)] = 100 × [(delta WI)/(40 − 5)]; greater than 100% - coupon became more reflective.
[5]pH adjusted with NaOH.

TABLE 3

THE EFFECT OF SODIUM BICARBONATE, ADDED FROM SOFTENED NATURAL MINERAL WATER AT VARIOUS pH's, AND OZONE ON PROTEIN REMOVAL FROM STAINLESS STEEL

| Conditions[1] | pH | Ozonated L-value | Soiled L-value | Delta L-value[2] | % Soil Removal[3] |
|---|---|---|---|---|---|
| 1 run 21 (244 ppm $NaHCO_3$)[4] | 7.8 | 65.08 | 63.79 | 1.28 | 10% |
| 2 run 2 (244 ppm $NaHCO_3$)[4] | 8.7 | 76.86 | 63.35 | 13.51 | 103%[5] |
| 3 run 9 (244 ppm $NaHCO_3$)[4] | 9.0 | 75.77 | 63.61 | 12.15 | 94% |
| 4 run 13 (244 ppm $NaHCO_3$)[4] | 9.5 | 76.98 | 63.05 | 13.93 | 104%[5] |
| 5 run 39 (244 ppm $NaHCO_3$)[4] | 10.0 | 77.31 | 63.86 | 13.45 | 106%[5] |
| 6 run 102 (244 ppm $NaHCO_3$)[4] | 12.2 | 65.97 | 63.72 | 2.25 | 18% |

[1]Experimental: ozone was generated at a rate of: air flow - 40 SCFH, 15 psi, 6.3 amps., and injected into the softened mineral water (containing 244 ppm of $NaHCO_3$ from natural mineral sources), at a temp = 74° F., with a spray flow of 1.0 gal/min, and a reaction time of 30 minutes. NaOH was used to vary the pH.
[2]Delta L = ending L value of cleaned (ozonated) coupon minus starting L value of soiled coupon.
[3]% Soil Removal - 100 × [delta L/(avg. cleaned L − soiled L)], where the avg. new-cleaned L is taken from an avg. of 100 new coupons, and is L = 76.5.
[4]Bicarbonate level from natural mineral water.
[5]Greater than 100% cleaning since the coupon became more reflective than a new, avg. cleaned coupon.

TABLE 4

THE EFFECT OF OXIDATION-REDUCTION POTENTIAL (ORP) AT pH's ABOVE 8.0 ON PROTEIN REMOVAL FROM STAINLESS STEEL

| Conditions[1] | Gas | ORP (mV) | Ozonated L-value | Soiled L-value | Delta L-value[2] | % Soil Removal[3] |
|---|---|---|---|---|---|---|
| 1 run 92 | air | 24 | 64.98 | 63.43 | 1.55 | 11.9% |
| 2 run 57 | $O_3$ | 219 | 58.05 | 57.28 | 0.77 | 4.0% |
| 3 run 58 | $O_3$ | 274 | 58.96 | 57.97 | 0.99 | 5.3% |
| 4 run 11 | $O_3$ | 554 | 65.30 | 64.22 | 1.08 | 8.8% |
| 5 run 59 | $O_3$ | 600 | 60.87 | 59.25 | 1.61 | 9.4% |
| 6 run 20 | $O_3$ | 703 | 65.08 | 63.79 | 1.28 | 10.1% |
| 7 run 60 | $O_3$ | 717 | 59.23 | 58.00 | 1.23 | 6.7% |

TABLE 4-continued

THE EFFECT OF OXIDATION-REDUCTION POTENTIAL (ORP) AT pH's ABOVE 8.0 ON PROTEIN REMOVAL FROM STAINLESS STEEL

| Conditions[1] | Gas | ORP (mV) | Ozonated L-value | Soiled L-value | Delta L-value[2] | % Soil Removal[3] |
|---|---|---|---|---|---|---|
| 8 run 61 | $O_3$ | 777 | 62.67 | 57.77 | 4.90 | 26.1% |
| 9 run 57 | $O_3$ | 819 | 72.02 | 63.86 | 8.17 | 64.6% |
| 10 run 26 | $O_3$ | 850 | 74.75 | 60.81 | 13.93 | 88.8% |
| 11 run 39 | $O_3$ | 909 | 77.31 | 63.86 | 13.45 | 106.4%[4] |
| 12 run 97 | $O_3$ | 920 | 77.09 | 64.02 | 13.07 | 104.7%[4] |
| 13 run 13 | $O_3$ | 940 | 76.98 | 63.05 | 13.93 | 103.6%[4] |
| 14 run 15 | $O_3$ | 949 | 76.27 | 63.81 | 12.45 | 98.2% |
| 15 run 25 | $O_3$ | 965 | 76.50 | 63.66 | 12.84 | 100.0%[4] |
| 16 run 16 | $O_3$ | 980 | 76.73 | 64.10 | 12.62 | 101.9%[4] |
| 17 run 103 | $O_3$ | 999 | 76.85 | 64.02 | 14.07 | 102.5%[4] |

[1]Experimental: the variable ORP values were obtained using a variety of reaction conditions; such as variable amperage charges to the ozone generator, mixes of NaOH—$NaHBO_3$—$NaHCO_3$, run times, pH's, and gas flow rates. All reactions were done at a temp = 74° F., with a spray flow of 1.0 gal/min.
[2]Delta L - ending L value of cleaned (ozonated) coupon minus starting L value of soiled coupon.
[3]% Soil Removal = 100 × [delta L/(avg. new-cleaned L − soiled L)], where the avg. new-cleaned L is taken from an avg. of 100 new coupons, and is L - 76.5.
[4]Greater than 100% cleaning since the coupon became more reflective than a new, avg. cleaned coupon.

TABLE 5

THE EFFECT OF RESIDENCE TIME ON PROTEIN REMOVAL FROM STAINLESS STEEL, USING AQUEOUS OZONE SOLUTIONS

| Conditions[1] | Residence Time (seconds) | Ozonated L-value | Soiled L-value | Delta L-value[2] | % Soil Removal[3] |
|---|---|---|---|---|---|
| 1 run 8 | 31 | 76.11 | 63.38 | 12.72 | 97% |
| 2 run 19 | 92 | 76.76 | 62.45 | 14.30 | 102%[4] |
| 3 run 25 | 153 | 76.50 | 63.66 | 12.84 | 100% |
| 4 run 97 | 214 | 77.09 | 64.02 | 13.07 | 105%[4] |

[1]Experimental: ozone was generated at a rate of: air flow = 40 SCFH, 15 psi, 6.3 amps, and injected into water a temp = 74° F., with a solution pumping rate of 1 min/gal, at a pH = 8.9 with 1000 pm $NaHCO_3$.
[2]Delta L - ending L value of cleaned (ozonated) coupon minus starting L value of soiled coupon.
[3]% Soil Removal = 100 × [delta L/(avg. new-cleaned L − soiled L)], where the avg. new-cleaned L is taken from an avg. of 100 new coupons, and is L - 76.5.
[4]Greater than 100% cleaning since the coupon became more reflective than a new, avg. cleaned coupon.

TABLE 6

THE EFFECT OF VARIOUS LEWIS BASES AND OZONE ON PROTEIN REMOVAL FROM STAINLESS STEEL

| Conditions[1] | Gas | $NaHCO_3$ Conc. (ppm) | $Na_5P_3O_{10}$ Conc. (ppm) | $Na_2HPO_4$ Conc. (ppm) | $Na_4SiO_4$ Conc. (ppm) | pH | Delta L-value[2] | Delta Whiteness Index (WI)[3] | % Soil Removal[4] |
|---|---|---|---|---|---|---|---|---|---|
| 1 control (no additive) | air | 0 | 0 | 0 | 0 | 8.0 | 0.3 | 0.5 | 1.4% |
| 2 control (no additive) | air | 0 | 0 | 0 | 0 | 10.3 | −0.5 | 0.5 | 1.4% |
| 3 control (no additive) | $O_3$ | 0 | 0 | 0 | 0 | 8.0 | 4.5 | 4.4 | 12.6% |
| 4 control (no additive) | $O_3$ | 0 | 0 | 0 | 0 | 10.3 | 6.9 | 19.8 | 56.5% |
| 5 bicarbonate system | air | 1000 | 0 | 0 | 0 | 8.0 | 1.8 | 7.8 | 22.2% |
| 6 bicarbonate system | $O_3$ | 250 | 0 | 0 | 0 | 8.0 | 11.6 | 16.2 | 46.3% |
| 7 bicarbonate system | $O_3$ | 1000 | 0 | 0 | 0 | 8.0 | 14.99 | 29.3 | 83.7% |
| 8 bicarbonate system | air | 1000 | 0 | 0 | 0 | 10.3 | 1.5 | −3.9 | 0.0% |
| 9 bicarbonate system | $O_3$ | 250 | 0 | 0 | 0 | 10.3 | 15.8 | 33.4 | 95.4% |
| 10 bicarbonate system | $O_3$ | 1000 | 0 | 0 | 0 | 10.3 | 14.9 | 34.4 | 98.3% |
| 11 tripolyphosphate system | air | 0 | 1000 | 0 | 0 | 8.0 | −0.2 | −1.0 | 0.0% |
| 12 tripolyphosphate system | $O_3$ | 0 | 50 | 0 | 0 | 8.0 | 4.3 | 1.8 | 5.1% |
| 13 tripolyphosphate system | $O_3$ | 0 | 250 | 0 | 0 | 8.0 | 2.8 | 3.2 | 9.1% |
| 14 tripolyphosphate system | $O_3$ | 0 | 1000 | 0 | 0 | 8.0 | 2.9 | 6.2 | 17.7% |
| 15 tripolyphosphate system | air | 0 | 1000 | 0 | 0 | 10.3 | 0.9 | 0.3 | 1.0% |
| 16 tripolyphosphate system | $O_3$ | 0 | 50 | 0 | 0 | 10.3 | 8.7 | 21.0 | 60.0% |
| 17 tripolyphosphate system | $O_3$ | 0 | 250 | 0 | 0 | 10.3 | 8.8 | 23.7 | 67.7% |
| 18 tripolyphosphate system | $O_3$ | 0 | 1000 | 0 | 0 | 10.3 | 11.4 | 37.1 | 100.0% |
| 19 orthophosphate system | air | 0 | 0 | 1000 | 0 | 8.0 | 1.5 | −6.5 | 0.0% |
| 20 orthophosphate system | $O_3$ | 0 | 0 | 250 | 0 | 8.0 | 5.2 | 2.6 | 7.4% |
| 21 orthophosphate system | $O_3$ | 0 | 0 | 1000 | 0 | 8.0 | 2.4 | 1.4 | 4.0% |
| 22 orthophosphate system | air | 0 | 0 | 1000 | 0 | 10.3 | 0.1 | 1.8 | 5.1% |
| 23 orthophosphate system | $O_3$ | 0 | 0 | 250 | 0 | 10.3 | 11.0 | 15.3 | 43.7% |
| 24 orthophosphate system | $O_3$ | 0 | 0 | 1000 | 0 | 10.3 | 10.2 | 18.1 | 51.7% |
| 25 orthosilicate system | air | 0 | 0 | 0 | 1000 | 8.0 | 0.9 | 4.5 | 12.8% |
| 26 orthosilicate system | $O_3$ | 0 | 0 | 0 | 250 | 8.0 | 5.0 | 2.3 | 6.6% |
| 27 orthosilicate system | air | 0 | 0 | 0 | 1000 | 10.3 | 0.2 | −1.2 | 0.0% |
| 28 orthosilicate system | $O_3$ | 0 | 0 | 0 | 250 | 10.3 | 11.3 | 23.2 | 66.3% |
| 29 orthosilicate system | $O_3$ | 0 | 0 | 0 | 1000 | 10.3 | 10.8 | 17.2 | 49.1% |

[1]Experimental: ozone was generated at a rate of: air flow = 40 SCFH, 15 psi, 6.3 amps, and injected into water at a temperature = 74° F., with a spray flow of 0.5 gal/min, and a reaction time of 10 minutes. The solutions wee buffered to the desired pH's using a boric acid;/sodium hydroxide buffer.
[2]Delta L = ending L value of cleaned coupon minus starting L value of soiled coupon.
[3]Delta WI = ending WI value of cleaned coupon minus starting WI value of soiled coupon.
[4]% Soil Removal = 100 × [delta WI/(avg. cleaned WI − avg. soiled WI)]

TABLE 7

THE EFFECT OF SURFACE ACTIVE AGENTS WITH OZONE ON PROTEIN REMOVAL FROM STAINLESS STEEL

| Conditions[1] | Gas | Surfactant Conc. (ppm) | Delta L-Value[2] | Delta Whiteness Index (WI)[3] | % Soil Removal[4] |
|---|---|---|---|---|---|
| 1 control (no additive) | air | 0 | 0.8 | −1.9 | 0.0% |
| 2 control (no additive) | $O_3$ | 0 | 10.9 | 25.2 | 72.1% |
| 3 Hostapur SAS 93[5] | $O_3$ | 50 | 13.8 | 27.9 | 79.7% |
| 4 Supra 2[6] | $O_3$ | 50 | 12.9 | 28.9 | 82.6% |
| 5 APG-325[7] | $O_3$ | 50 | 15.3 | 25.1 | 71.7% |

[1]Experimental: ozone was generated at a rate of: air flow = 40 SCFH, 15 psi, 6.3 amps, and injected into water at a temperature = 74° F., with a spray flow of 0.5 gal/min, and a reaction time of 10 minutes. The solutions wee buffered to the desired pH's using a boric acid;/sodium hydroxide buffer.
[2]Delta L = ending L value of cleaned coupon minus starting L value of soiled coupon.
[3]Delta WI = ending WI value of cleaned coupon minus starting WI value of soiled coupon.
[4]% Soil Removal = 100 × [delta WI/(avg. cleaned WI − avg. soiled WI)]
[5]A secondary alkane sulfonate (Hostapur SAS 93) - 93%, added at 50 ppm active.
[6]A cocoa dimethyl amine oxide - 32%, added at 50 ppm active.
[7]APG 325 is an alkyl glycoside - 40%, added at 50 ppm active.

TABLE 8

THE EFFECT OF AQUEOUS OZONE ON PROTEIN REMOVAL FROM CERAMIC GLASS

| Conditions[1] | Reaction Minutes Gas | % Soil | Removal[2] |
|---|---|---|---|
| 1 1000 ppm KOH | air | 2 | <10% |
| 2 1000 ppm KOH | $O_3$ | 2 | >90% |
| 3 1000 ppm KOH | air | 10 | <10% |
| 4 1000 ppm KOH | $O_3$ | 10 | about 100% |

[1]Experimental: ozone was generated at a rate of: air flow = 40 SCFH, 15 psi, 6.3 amps, and injected into water at a temperature = 74° F., with a spray flow of 1.0 ga./min.
[2]% Soil Removal is based on a visual inspection after straining with Coomassie Blue dye, and is a comparison of the cleaned vs. newly soiled cup stains.

The preferred embodiment of the invention is the removal of proteinaceous residue from hard solid surfaces, the scope of the invention is not limited to this application. The use of ozonized solution can be helpful in the removal of other soil such grease or oil, carbohydrate, or the like. Also, the ozonized cleaning solution can be used on soiled, flexible surfaces as well as hard surfaces. Even though the preferred embodiment is the injection of ozone formed in electrical discharge in air into a stream of aqueous carrier solution, the method of the formation of the ozone or how ozone is incorporated into the carrier solution is not essential to the invention. The invention resides in the claims hereinafter appended.

The specification, discussion and the parameters used in the examples can be varied without departing from the scope and spirit of this invention and the appended claims.

We claim:

1. A composition for cleaning inorganic or organic soil from a surface, the composition comprising:

(a) an aqueous medium;

(b) at least about 100 parts of a Lewis base per million parts by weight of the composition; and (c) an effective concentration of ozone sufficient to produce an oxidation-reduction potential of at least +350 mV with respect to an Ag/AgCl reference electrode.

2. The composition for cleaning of claim 1, wherein the aqueous medium is an alkaline solution having a pH of about 7.0 or more and the oxidation-reduction potential is at least +600 mV.

3. The composition for cleaning of claim 2, wherein the alkaline solution comprises a compound selected from the group of alkali metal bases consisting of an hydroxide, a silicate, a polysilicate, a phosphate, a polyphosphate, a borate, a bicarbonate, a carbonate or mixtures thereof.

4. The composition for cleaning of claim 3, wherein the aqueous medium has a pH of about 7.5 or more and the oxidation-reduction potential is greater than +750 mV.

5. The composition for cleaning of claim 4, wherein the aqueous solution is an alkaline'solution having a pH of greater than 8.0.

6. The composition for cleaning of claim 1, wherein the cleaning composition comprises at least 0.1 ppm of dissolved ozone.

7. The composition for cleaning of claim 2, wherein the aqueous alkaline solution has a pH of 8.5 and comprises an alkali metal carbonate, an alkali metal bicarbonate or mixtures thereof.

8. The composition for cleaning of claim 7, wherein the aqueous alkaline solution comprises sodium or potassium carbonate and sodium or potassium bicarbonate.

9. The composition for cleaning of claim 1, wherein the Lewis base comprises a sequestrant composition.

10. The composition for cleaning of claim 9, wherein the sequestrant composition comprises: an organic sequestrant selected from the group consisting of EDTA, NTA, a gluconic acid, a phosphonic acid, a phosphonate, a polyacrylic acid or a combination thereof.

11. The composition of claim 9 wherein the sequestrant composition comprises an inorganic sequestrant selected from the group consisting of an alkali metal pyrophosphate or an alkali metal tripolyphosphate.

12. The composition for cleaning of claim 2, wherein the cleaning composition further comprises an effective wetting amount of a surfactant.

13. The composition for cleaning of claim 12, wherein the surfactant is a nonionic surfactant.

14. A cleaning composition for cleaning solid surfaces, the cleaning composition comprises:

(a) an aqueous medium with a pH greater than 7.5;

(b) at least about 100 parts of an alkali metal carbonate or bicarbonate per each million parts by weight of the composition; and (c) an effective concentration of ozone sufficient to produce an oxidation-reduction potential of at least +550 mV with respect to an Ag/AgCl reference electrode.

15. The cleaning composition of claim 14 wherein the alkali metal is sodium or potassium and the pH is 8–11.

16. A cleaning composition for cleaning solid surfaces, the cleaning composition comprises:

(a) an aqueous medium of pH between about 8–11;

(b) at least about 100 parts of an alkali metal phosphate, pyrophosphate or tripolyphosphate per each million parts by weight of the composition; and (c) an effective concentration of an active ozone composition sufficient to produce an oxidation-reduction potential of at least +600 mV with respect to an Ag/AgCl reference electrode.

17. The cleaning composition of claim 16 wherein the alkali metal phosphate species comprises sodium orthophosphate.

18. The composition of claim 16 wherein the alkali metal tripolyphosphate comprises sodium tripolyphosphate.

* * * * *